US009977363B2

(12) United States Patent
Hirado et al.

(10) Patent No.: US 9,977,363 B2
(45) Date of Patent: May 22, 2018

(54) IMAGE FORMING APPARATUS WITH SELECTIVE CONTROL OF CHARGES APPLIED TO RESIDUAL TONER

(71) Applicant: CANON KABUSHIKI KAISHA, Tokyo (JP)

(72) Inventors: Yasuharu Hirado, Mishima (JP); Masaki Shimomura, Mishima (JP); Yusaku Iwasawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/460,745

(22) Filed: Mar. 16, 2017

(65) Prior Publication Data

US 2017/0285508 A1 Oct. 5, 2017

(30) Foreign Application Priority Data

Mar. 31, 2016 (JP) ..... 2016-073095

(51) Int. Cl.
*G03G 15/16* (2006.01)
*G03G 15/00* (2006.01)
*G03G 15/02* (2006.01)

(52) U.S. Cl.
CPC ..... *G03G 15/0266* (2013.01); *G03G 15/161* (2013.01); *G03G 15/168* (2013.01)

(58) Field of Classification Search
CPC ..... G03G 15/161; G03G 15/168; G03G 21/0005; G03G 2215/1661; G03G 2221/0005
USPC ..... 399/71, 101, 45
See application file for complete search history.

(56) References Cited

U.S. PATENT DOCUMENTS 5,732,310 A 3/1998 Hiroshima et al.
5,999,763 A * 12/1999 Hiroshima ..... G03G 15/161 399/297
6,308,019 B1 10/2001 Miyashiro et al.
6,879,801 B2 * 4/2005 Soda ..... G03G 15/0216 399/101 X
9,372,462 B1 * 6/2016 Ohta
2005/0078972 A1 * 4/2005 Soda ..... G03G 15/168 399/44

(Continued)

FOREIGN PATENT DOCUMENTS

JP 2000-089537 A 3/2000
JP 3267507 B2 3/2002
JP 2012-168476 A 9/2012

*Primary Examiner* — Sophia S Chen
(74) *Attorney, Agent, or Firm* — Fitzpatrick, Cella, Harper & Scinto

(57) ABSTRACT

The image forming apparatus includes a control unit configured to selectively execute an operation for applying a voltage with a polarity opposite to an original charging polarity of a toner to a first charging member and a second charging member and an operation for applying a voltage with the polarity opposite to the original charging polarity of the toner to one of the first charging member and the second charging member and a voltage with the same polarity as the original charging polarity of the toner to another of the first charging member and the second charging member as a cleaning operation for charging a secondary transfer residual toner to the polarity opposite to the original charging polarity of the toner by using the first charging member and the second charging member to transfer the secondary transfer residual toner onto an image bearing member.

12 Claims, 5 Drawing Sheets

(56) References Cited

U.S. PATENT DOCUMENTS

| | | | | |
|---|---|---|---|---|
| 2006/0171735 | A1* | 8/2006 | Hamada | G03G 15/161 399/101 |
| 2012/0027453 | A1* | 2/2012 | Watanabe | G03G 15/161 399/101 |
| 2012/0106998 | A1* | 5/2012 | Ishizumi | G03G 15/161 399/50 |
| 2014/0105626 | A1* | 4/2014 | Ohno | G03G 15/80 399/101 X |
| 2015/0030349 | A1* | 1/2015 | Osawa | G03G 15/161 399/101 |

* cited by examiner

IMAGE FORMING APPARATUS WITH SELECTIVE CONTROL OF CHARGES APPLIED TO RESIDUAL TONER

BACKGROUND OF THE INVENTION

Field of the Invention

The present invention relates to an image forming apparatus using an electrophotographic system or an electrostatic recording system.

Description of the Related Art

Hitherto, as an image forming apparatus using an electrophotographic system or an electrostatic recording system, there exists an image forming apparatus using an intermediate transfer system. In the intermediate transfer system, toner images formed on a plurality of image bearing members are primarily transferred onto an intermediate transferring member so as to be overlapped with each other. Thereafter, the toner images are secondarily transferred from the intermediate transferring member onto a recording material, for example, paper, thereby outputting an image.

In the image forming apparatus described above, a toner (secondary transfer residual toner) remains on the intermediate transferring member after the secondary transfer step. Therefore, the secondary transfer residual toner is required to be removed from the intermediate transferring member so as to be collected. As a method of removing the secondary transfer residual toner from the intermediate transferring member, the following method is known. Specifically, after the secondary transfer residual toner is charged to a polarity opposite to an original charging polarity of the toner by a charging unit, the secondary transfer residual toner is transferred onto a photosensitive member simultaneously with the primary transfer at a primary transfer portion so as to be collected by a cleaning unit of the photosensitive member (Japanese Patent No. 3267507).

However, it is found that a configuration for transferring the secondary transfer residual toner onto the photosensitive member and collecting the secondary transfer residual toner after charging the secondary transfer residual toner to the polarity opposite to the original charging polarity of the toner has the following problem.

When the secondary transfer residual toner is strongly charged to the polarity opposite to the original charging polarity of the toner, the secondary transfer residual toner is collected by the photosensitive member at the primary transfer portion after being further strongly charged by the charging unit. At this time, the secondary transfer residual toner is collected by the photosensitive member together with (while electrostatically adsorbing) the toner with the original charging polarity that is to be primarily transferred onto the intermediate transferring member at the primary transfer portion. As a result, an image defect called "ghost" disadvantageously occurs. A mechanism of causing the ghost is now described.

Charges of the secondary transfer residual toner greatly change depending on a voltage applied to a secondary transfer portion. When the voltage applied to the secondary transfer portion is low, an electric field for transferring the toner from the intermediate transfer member onto the recording material is weak. Therefore, the toner having the charges with the original charging polarity remains on the intermediate transferring member as the secondary transfer residual toner without being successfully transferred onto the recording material (this phenomenon is hereinafter referred to as "weak hollow"). On the other hand, when the voltage applied to the secondary transfer portion is high, a discharge occurs between the intermediate transferring member and the recording material. As a result, the toner has charges with the polarity opposite to the original charging polarity, and therefore remains on the intermediate transferring member as the secondary transfer residual toner without being transferred onto the recording material (this phenomenon is hereinafter referred to as "strong hollow"). Therefore, it is desirable to apply to the secondary transfer portion an appropriate voltage that does not cause the "weak hollow" or the "strong hollow".

Meanwhile, when the voltage applied to the secondary transfer portion is lowered to such a level that the "strong hollow" does not occur, an image defect called "explosion" sometimes occurs independently of the above-mentioned "weak hollow". The "explosion" is an image defect caused in the following manner. Specifically, when charges on the recording material charged at the secondary transfer portion are low, the toner transferred onto the recording material cannot be sufficiently attracted to the recording material by an electrical force. As a result, the toner is scattered onto a non-image portion of the recording material to cause an image defect appearing as if the toner exploded. The "explosion" is liable to occur when an electric resistance of the recording material is high or an electric resistance of a secondary transfer roller used to apply the voltage to the secondary transfer portion is low.

Here, the "strong hollow" is an image defect appearing as a slightly low image-density portion which cannot be visually observed on an image or as extremely small sparsely scattered dot-like white spots. In contrast, the "explosion" appears as an explosion-like pattern on the image. Therefore, the "explosion" is more noticeable than the "strong hollow" as the image defect.

Thus, suppression of the "explosion" is sometimes regarded as priority by slightly increasing the voltage applied to the secondary transfer portion. When the voltage that may cause the "strong hollow" is applied to the secondary transfer portion, the secondary transfer residual toner has strong charges with the polarity opposite to the original charging polarity. As a result, the amount of charges is further increased by the charging unit, thereby sometimes causing the above-mentioned "ghost".

SUMMARY OF THE INVENTION

A purpose of the invention is to provide an image forming apparatus including an image bearing member configured to bear a toner image thereon, an intermediate transferring member onto which the toner image is to be primarily transferred from the image bearing member, a secondary transfer member configured to secondarily transfer the toner image from the intermediate transferring member onto a recording material, a transfer power supply unit configured to apply a transfer voltage to the secondary transfer member, a first charging member configured to charge a residual toner remaining on the intermediate transferring member, a second charging member configured to charge the residual toner remaining on the intermediate transferring member, a charging power supply unit configured to apply a charging voltage to each of the first charging member and the second charging member, and a control unit configured to control the charging power supply unit, the control unit being configured to cause a voltage with a polarity opposite to an original charging polarity of a toner to be applied from the charging power supply unit to the first charging member and the second charging member in a first mode in which application of a first transfer voltage from the transfer power supply unit to the secondary transfer member is set, and cause the voltage with the original charging polarity to be applied from the charging power supply unit to the first charging member and the voltage with the opposite polarity to be applied from the charging power supply unit to the second charging member in a second mode in which application of a second transfer voltage higher than the first transfer voltage from the transfer power supply unit to the secondary transfer member is set.

Further features of the present invention will become apparent from the following description of exemplary embodiments with reference to the attached drawings.

DESCRIPTION OF THE EMBODIMENTS

Now, an image forming apparatus according to the present invention is described in detail with reference to the attached drawings.

First Embodiment

1. Overall Configuration and Operation of Image Forming Apparatus

Figure 1:
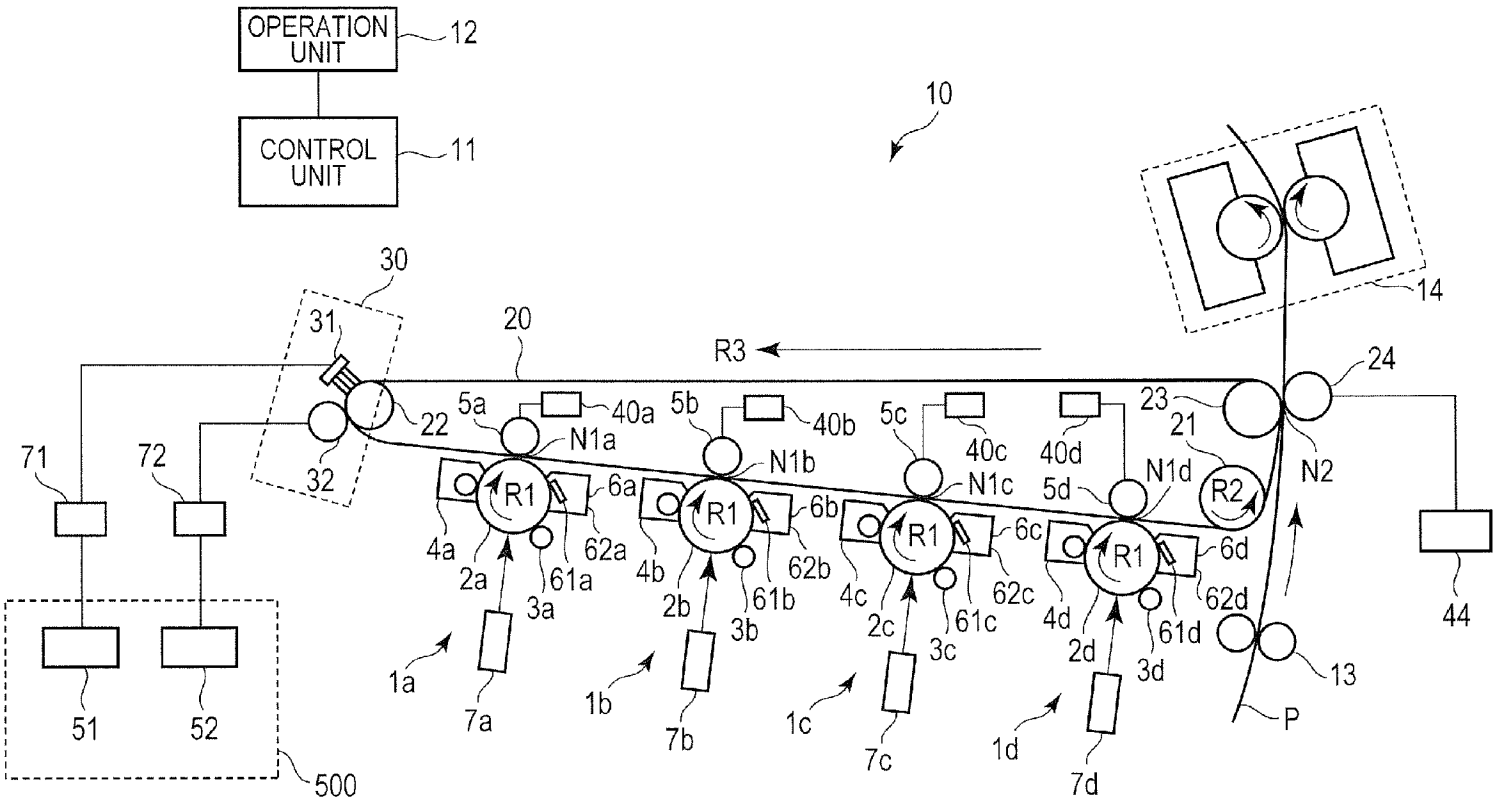
FIG. 1 is a schematic sectional view of an image forming apparatus according to an embodiment of the present invention.

FIG. 1 is a schematic sectional view of an image forming apparatus 10 according to a first embodiment of the present invention. The image forming apparatus 10 includes, as a plurality of image forming portions (stations), a first image forming portion 1*a* configured to form a yellow image, a second image forming portion 1*b* configured to form a magenta image, a third image forming portion 1*c* configured to form a cyan image, and a fourth image forming portion 1*d* configured to form a black image. In this embodiment, configurations of the first to fourth image forming portions 1*a* to 1*d* are substantially the same except for differences in toner color used in a development step. Therefore, the suffixes a, b, c and d in the reference symbols, which respectively denote the different colors for which components are provided, are omitted so as to collectively describe the components unless a distinction is specially needed. In this embodiment, the image forming portion 1 includes a photosensitive member 2, a drum charging roller 3, an exposure device 7, a developing device 4 (4*a*-4*d*) including a developing roller 8 (8*a*-8*d*), a primary transfer roller 5, and a drum cleaning device 6, which are described later.

The drum-shaped photosensitive member (electrophotographic photosensitive member) 2 serving as an image bearing member is rotationally driven at a predetermined peripheral speed in a direction indicated by an arrow R1 in FIG. 1. A surface of the rotated photosensitive member 2 is uniformly charged to a predetermined potential with a predetermined polarity (negative polarity in this embodiment) by the drum charging roller 3 being a roller-type charging member serving as a photosensitive member charging unit. The charged surface of the photosensitive member 2 is scanned and exposed to light in accordance with image information by the exposure device (laser scanner) 7 serving as an exposure unit. As a result, an electrostatic latent image (electrostatic image) is formed on the photosensitive member 2. The electrostatic latent image formed on the photosensitive member 2 is developed by the developing device 4 serving as a development unit using a toner, thereby forming a toner image on the photosensitive member 2. In this embodiment, the toner charged to the same polarity (negative polarity in this embodiment) as the charging polarity of the photosensitive member 2 adheres onto an exposed portion on the photosensitive member 2, which has a reduced absolute value of the potential through the exposure to light after the uniform charging process (reversal development system). In this embodiment, an original charging polarity that is the charging polarity of the toner at the time of development is the negative polarity. Thus, the toner that forms the toner image mainly has charges with the negative polarity.

An intermediate transferring belt 20 made up of an endless belt is arranged so as to be opposed to each of the photosensitive members 2. The intermediate transferring belt 20 is an example of a movable intermediate transferring member configured to convey the toner images, which are primarily transferred from the plurality of photosensitive members 2, such that the toner images are secondarily transferred onto a recording material P. The intermediate transferring belt 20 is looped around a drive roller 21, a tension roller 22, and an opposed secondary transfer roller 23 serving as a plurality of tensioning rollers so as to be tensioned with a predetermined tension. The intermediate transferring belt 20 is rotated (moved to be circulated) at a peripheral speed (process speed) equal to the peripheral speed of the photosensitive member 2 in a direction indicated by an arrow R3 in FIG. 1 by rotational drive of the drive roller 21 in a direction indicated by an arrow R2 in FIG. 1. On an inner circumferential surface side of the intermediate transferring belt 20, primary transfer rollers 5*a* to 5*d* being roller-type primary transfer members serving as primary transfer units are arranged so as to respectively correspond to the photosensitive members 2. The primary transfer roller 5 is pressed toward the photosensitive member 2 through the intermediate transferring belt 20 so as to form a primary transfer portion N1 at which the photosensitive member 2 and the intermediate transferring belt 20 come into contact with each other.

The toner image formed on the photosensitive member 2 as described above is transferred (primarily transferred) onto the rotated intermediate transferring belt 20 at the primary transfer portion N1 by a function of the primary transfer roller 5. During a primary transfer step, a primary transfer voltage with a polarity (positive polarity in this embodiment) opposite to the original charging polarity of the toner is applied from a primary transfer power supply (high-voltage power supply circuit) 40. For example, at the time of formation of a full-color image, the toner images of yellow, magenta, cyan, and black formed respectively on the photosensitive members 2 are sequentially transferred onto the intermediate transferring belt 20 so as to be overlapped with each other.

At a position opposed to the opposed secondary transfer roller 23 on an outer circumferential surface side of the intermediate transferring belt 20, a secondary transfer roller 24 being a roller-type secondary transfer member serving as a secondary transfer unit is arranged. The secondary transfer roller 24 is pressed toward the opposed secondary transfer roller 23 to form a secondary transfer portion N2 at which the intermediate transferring belt 20 and the secondary transfer roller 24 come into contact with each other.

The toner images formed on the intermediate transferring belt 20 as described above are transferred onto the recording material P, for example, paper, sandwiched between the intermediate transferring belt 20 and the secondary transfer roller 24 to be conveyed by a function of the secondary transfer roller 24 at the secondary transfer portion N2. During a secondary transfer step, a secondary transfer voltage with the polarity (positive polarity in this embodiment) opposite to the original charging polarity of the toner is applied from a secondary transfer power supply (high-voltage power supply circuit) 44. Here, the secondary transfer power supply 44 forms a transfer power supply unit configured to apply the secondary transfer voltage to the secondary transfer member. The recording material P is conveyed to registration rollers 13 by a feeding/conveying device (not shown), and is fed to the secondary transfer portion N2 in synchronization with the toner images formed on the intermediate transferring belt 20 by the registration rollers 13.

The recording material P having the toner images transferred thereon is conveyed to a fixing device 14 serving as a fixing unit, and in the fixing device 14, the toner images are heated and pressurized to be fixed (melted and caused to firmly adhere). Thereafter, the recording material P is discharged out of an apparatus main body of the image forming apparatus 10.

Further, the toner (primary transfer residual toner) remaining on the photosensitive member 2 after the primary transfer step is removed from the photosensitive member 2 to be collected by the drum cleaning device 6 serving as a photosensitive member cleaning unit. The drum cleaning device 6 scrapes the primary transfer residual toner from a surface of the rotated photosensitive member 2 with a cleaning blade 61 serving as a cleaning member arranged in contact with the photosensitive member 2, thereby collecting the primary transfer residual toner in a collected toner container 62.

Further, the toner (secondary transfer residual toner) remaining on the intermediate transferring belt 20 after the secondary transfer step is collected by using a belt cleaning mechanism 30 serving as an intermediate transfer member cleaning unit. The belt cleaning mechanism 30 is described later in detail.

In this embodiment, the intermediate transferring belt 20 is formed of a polyethylene naphthalate (PEN) resin. In this embodiment, the intermediate transferring belt 20 has a surface resistivity of $5.0\times10^{11}$ Ω/□ and a volume resistivity of $8.0\times10^{11}$ Ωcm. Further, the secondary transfer roller 24 is made up of, for example, an elastic member made of a sponge rubber or the like. In this embodiment, a nickel-plated steel rod having a diameter of 6 mm covered with an NBR hydrin rubber at a thickness of 6 mm is used as the secondary transfer roller 24. An electric resistance value of the secondary transfer roller 24 (in an unused state) is $3.0\times10^{7}$Ω when 1,000 V is applied under a state in which the secondary transfer roller 24 is pressed against an aluminum cylinder with a force of 9.8 N and is rotated at 50 mm/sec under an environment at a temperature of 23° C. and a relative humidity of 50%. The secondary transfer roller 24 is rotated along with movement of the intermediate transferring belt 20. Further, in this embodiment, each of the primary transfer power supply 40 and the secondary transfer power supply 44 can selectively apply a voltage with a positive polarity and a voltage with negative polarity.

Further, in this embodiment, a control unit (CPU) 11 serving as a control unit provided to the apparatus main body of the image forming apparatus 10 is configured to comprehensively control operations of sections and portions of the image forming apparatus 10 in accordance with a program stored in a storage unit (memory). In particular, in relation to this embodiment, the control unit 11 is configured to control switching of the polarity of each of outputs of cleaning power supplies 51 and 52, which are described later, so as to control a mode of a cleaning operation.

The image forming apparatus 10 now executes a job (printing operation) that is an operation series for forming an image on one or a plurality of the recording material P and outputting the image, which is started in response to a start instruction. The job generally includes an image formation step, a pre-rotation step, a sheet interval step executed when the images are formed on the plurality of recording materials P, and a post-rotation step. The image formation step corresponds to a period for formation of an electrostatic latent image of the image that is actually formed on the recording material P so as to be output, formation of the toner images, and the primary transfer and the secondary transfer of the toner images. The terms "during the image formation" and "image formation period" mean this period. More specifically, the image formation period differs depending on a position at which each of the steps of the formation of the electrostatic image, the formation of the toner images, and the primary transfer and the secondary transfer of the toner images is carried out. The pre-rotation step corresponds to a period from input of the start instruction to start of actual formation of the image, in which a preparatory operation prior to the image formation step is carried out. The sheet interval step (image interval step) corresponds to a period between image formation on the recording material P and image formation on the recording material P when the image formation step is continuously carried out for the plurality of recording materials P (continuous image formation). The post-rotation step corresponds to a period in which an organization operation (preparatory operation) after the image formation step is carried out. A non-image formation period is a period excluding the image formation period, and includes the above-mentioned pre-rotation step, sheet interval step, and post-rotation step, and a pre-multi-rotation step corresponding to a preparatory operation performed at power-on of the image forming apparatus 10 or at recovery from a sleep state.

2. Effects of Secondary Transfer Voltage on Image

Next, effects of the secondary transfer voltage on the image are described. In Table 1, a result of evaluation of occurrence of "explosion" and "strong hollow" in the configuration of this embodiment is shown. An experiment was carried out in the following procedure. Specifically, GFC-081 (Canon Marketing Japan Inc.; trade name) left under an environment at a temperature of 15° C. and a humidity of 10% for 48 hours to be dried was used as the recording material P. Further, cyan, magenta, yellow, black, red, blue, and green solid images (maximum-density level images) were output while changing the secondary transfer voltage. Then, for sampled evaluation images, the occurrence of the "explosion" and the occurrence of the "strong hollow" were evaluated. A basis weight of the above-mentioned GFC-081 is 81.4 g/m$^2$.

The occurrence of the "explosion" was evaluated with an "occurred" mark when an image appearing as if a liquid leaked around the solid image was generated and evaluated with a "Not occurred" mark when such a defective image was not generated.

Further, the occurrence of the "strong hollow" was evaluated based on a ratio of the toner on the intermediate transferring belt 20, which was transferred onto the recording material P, specifically, a transfer efficiency. Specifically, a rectangular toner image having a size of 100 mm×100 mm was transferred onto the intermediate transferring belt 20. A toner weight before the transfer of the toner image onto the recording material P and a toner weight on the intermediate transferring belt 20 after the transfer of the toner image onto the recording material P were measured. Then, a value calculated by Expression 1 was defined as the transfer efficiency. More specifically, the rectangular image was transferred twice while being shifted in a direction of rotation of the intermediate transferring belt 20. After the first rectangular image was transferred onto the recording material P and before the second rectangular image was transferred onto the recording material P, the intermediate transferring belt 20 was stopped to measure each weight of the first and second toner images, to thereby calculate the transfer efficiency. The toner weight was measured in the following manner. The toner on the intermediate transferring belt 20 was collected by a suction machine. A weight of a filter of the suction machine was measured before the suction of the toner and after the suction of toner. Then, a difference therebetween was calculated. A set value of the secondary transfer voltage that achieves the transfer efficiency of 90% or higher (set value that provides the highest transfer efficiency achievable in the image forming apparatus 10 in this embodiment) was set as an appropriate value in this embodiment.

Transfer Efficiency={Toner Weight before Transfer onto Recording Material P-Toner Weight after Transfer onto Recording Material *P*)/(Toner Weight before Transfer onto Recording Material *P*)}×100 (Expression 1)

TABLE 1

| Secondary transfer bias voltage | Explosion | Transfer efficiency |
|---|---|---|
| 3,000 V | occurred | 70% |
| 3,200 V | occurred | 80% |
| 3,400 V | Not occurred | 85% |
| 3,600 V | Not occurred | 90% |
| 3,800 V | Not occurred | 90% |
| 4,000 V | Not occurred | 80% |

As shown in Table 1, when the secondary transfer voltage was equal to or lower than 3,200 V, the "explosion" occurred. On the other hand, when the secondary transfer voltage was 3,400 V or lower, the above-mentioned "weak hollow" occurred to lower the transfer efficiency. Further, when the secondary transfer voltage was 4,000 V or higher, the "strong hollow" occurred to lower the transfer efficiency. From the result described above, in the configuration of this embodiment, it is understood that good image formation can be performed by setting a set value (target value) of the secondary transfer voltage to 3,600 V or higher and 3,800 V or lower when the above-mentioned recording material P is used.

3. Belt Cleaning Mechanism

Figure 2:
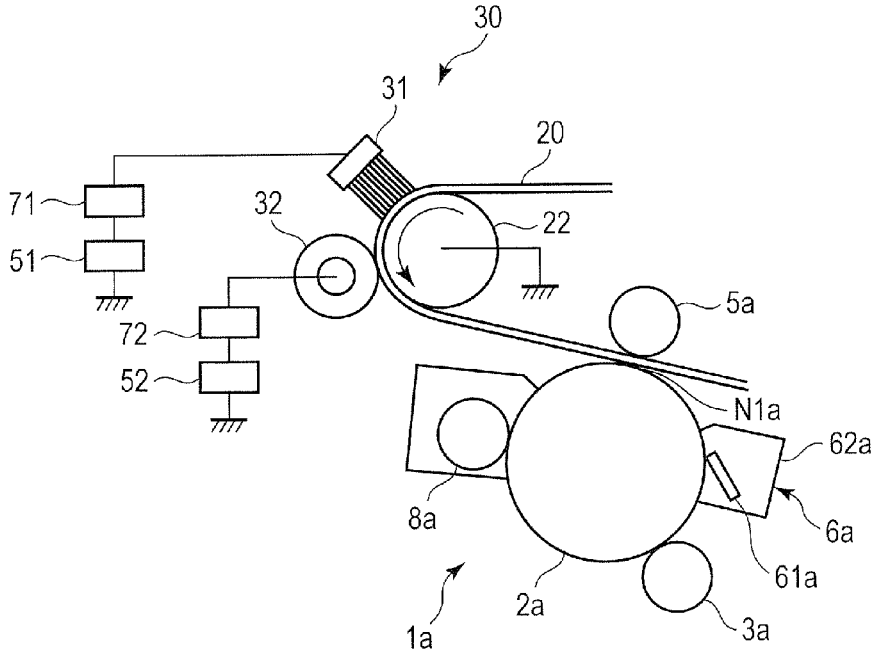
FIG. 2 is a schematic sectional view of a vicinity of a belt cleaning mechanism.

FIG. 2 is a schematic sectional view of a vicinity of the belt cleaning mechanism 30 in this embodiment. In this embodiment, the belt cleaning mechanism 30 includes a conductive brush 31 serving as a first charging member and a charging roller 32 serving as a second charging member as charging units capable of charging the secondary transfer residual toner. The conductive brush 31 and the charging roller 32 are arranged in contact with the intermediate transferring belt 20 on a downstream side of the secondary transfer portion N2 and on an upstream side of the primary transfer portion N1 (primary transfer portion N1*a* on the uppermost stream side) in a direction of travel of the intermediate transferring belt 20. In this embodiment, the conductive brush 31 and the charging roller 32 are pressed toward the tension roller 22 through the intermediate transferring belt 20 therebetween. Further, the charging roller 32 is arranged on a downstream side of the conductive brush 31 in the direction of travel of the intermediate transferring belt 20.

In this embodiment, the conductive brush 31 is a brush made of nylon with conductivity, and has a fineness of 7 decitex, a pile length of 5 mm, and a brush width (in the direction of travel of the intermediate transferring belt 20) of 5 mm. An electric resistance value of the conductive brush 31 is $1.0\times10^{6}\Omega$ when 500 V is applied under a state in which the conductive brush 31 is pressed against an aluminum cylinder with a force of 9.8 N and is rotated at 50 mm/sec. In place of the conductive brush 31, a foam sponge-like member (for example, formed of a urethane rubber or the NBR hydrin rubber) to be fixedly arranged, a rotatable fur brush roller, or a rotatable foam sponge roller may be used.

In this embodiment, the charging roller 32 is formed by covering a nickel-plated steel bar having a diameter of 6 mm with a solid elastic member having a thickness of 5 mm and being made of an EPDM rubber in which carbon is dispersed. An electric resistance value of the charging roller 32 is $5.0\times10^{7}\Omega$ when 500 V is applied under a state in which the charging roller 32 is pressed against an aluminum cylinder with a force of 9.8 N and is rotated at 50 mm/sec. The charging roller 32 is pressed against the tension roller 22 through the intermediate transferring belt 20 with a total pressure of 9.8 N.

The conducive brush 31 and the charging roller 32 are electrically connected respectively to the first cleaning power supply 51 and the second cleaning power supply (high-voltage power supply circuits) through a first ammeter 71 and a second ammeter 72 (current measurement circuits) serving as current detection units. The first cleaning power supply 51 and the second cleaning power supply 52 can selectively apply a voltage with a positive polarity and a voltage with a negative polarity respectively to the conductive brush 31 and the charging roller 32. The tension roller 22 is electrically grounded (connected to a ground). In this embodiment, the first cleaning power supply 51 and the second cleaning power supply 52 form a charging power supply unit 500. The charging power supply 500 is controlled by the control unit 11.

During a cleaning operation, DC voltages with a positive polarity are respectively applied from the first cleaning power supply 51 and the second cleaning power supply 52 to the conductive brush 31 and the charging roller 32. Output values of the DC voltages of the first cleaning power supply 51 and the second cleaning power supply 52 are respectively controlled based on currents detected by the first ammeter 71 and the second ammeter 72 to be subjected to constant current control so that the current values become equal to preset target current values. As each of the target current values, such a value that does not excessively charge the secondary transfer residual toner or does not cause insufficient cleaning due to insufficient charging is selected. In this embodiment, as representative examples, a target current value of the conductive brush 31 is 20 μA and a target current value of the charging roller 32 is 30 μA during the cleaning operation (described later in detail).

Figure 3:
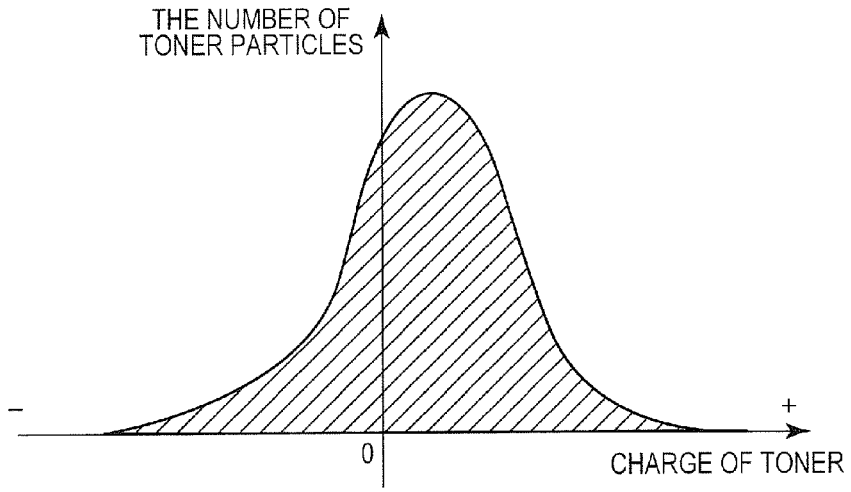
FIG. 3 is a graph for showing a distribution of charges of a secondary transfer residual toner.

The toner on the intermediate transferring belt 20 before the secondary transfer step has the negative polarity which is the same as the polarity of electrification charges on the surface of the photosensitive member 2, and is charged under a state in which a variation in distribution of the charges is small. On the other hand, the secondary transfer residual toner on the intermediate transferring belt 20 after the secondary transfer step now forms a broad charge distribution which has a peak shifted to the positive polarity side corresponding to the opposite polarity of the original charging polarity of particles of the toner. As a result, as shown in FIG. 3, the particles of the secondary transfer residual toner are in a state in which particles charged to the negative polarity, scarcely charged particles, and particles charged to the positive polarity are present at the same time. Among those particles, the number of particles charged to the positive polarity is relatively large.

The voltage with the positive polarity is applied to the conductive brush 31 during the cleaning operation. As a result, a positive electric field is formed from the conductive brush 31 toward the intermediate transferring belt 20. A part of the secondary transfer residual toner, which is charged to the negative polarity, is electrostatically collected by the conductive brush 31. In this manner, the amount of toner passing over the charging roller 32 during the cleaning operation can be reduced. In addition, the conductive brush 31 has a function of dispersing the toner passing thereover while charging (pre-charging) the toner to the positive polarity through a discharge caused between the conductive brush 31 and the secondary transfer residual toner.

Further, the voltage with the positive polarity is applied to the charging roller 32 during the cleaning operation. As a result, the secondary transfer residual toner which has passed over the conductive brush 31 is uniformly charged to the positive polarity through a discharge caused due to a potential difference between the charging roller 32 and the intermediate transferring belt 20.

Figure 4A:
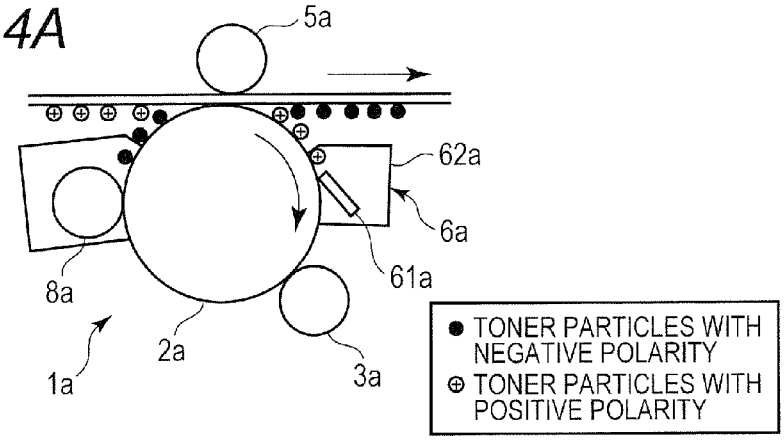
FIG. 4A, FIG. 4B, and FIG. 4C are schematic diagrams for illustrating an operation of the belt cleaning mechanism.

FIG. 4A is a schematic view for illustrating a state in which the secondary transfer residual toner is collected at the first image forming portion 1*a*. The secondary transfer residual toner charged to the positive polarity by the charging roller 32 is moved to the primary transfer portion N1*a* of the first image forming portion 1*a*. Then, the secondary transfer residual toner is transferred from the intermediate transferring belt 20 to the photosensitive member 2*a* by a function of the primary transfer voltage with the positive polarity applied to the primary transfer roller 5*a* at the first image forming portion 1*a*. Thereafter, the secondary transfer residual toner is removed from the photosensitive member 2*a* by the cleaning blade 61*a* of the drum cleaning device 6*a* to be collected in the collected toner container 62*a*. Further, at the first image forming portion 1*a*, image formation is performed at the same time. The toner image formed with the toner charged to the negative polarity is primarily transferred from the photosensitive member 2*a* onto the intermediate transferring belt 20 (collection simultaneous with the primary transfer).

Figure 4B:
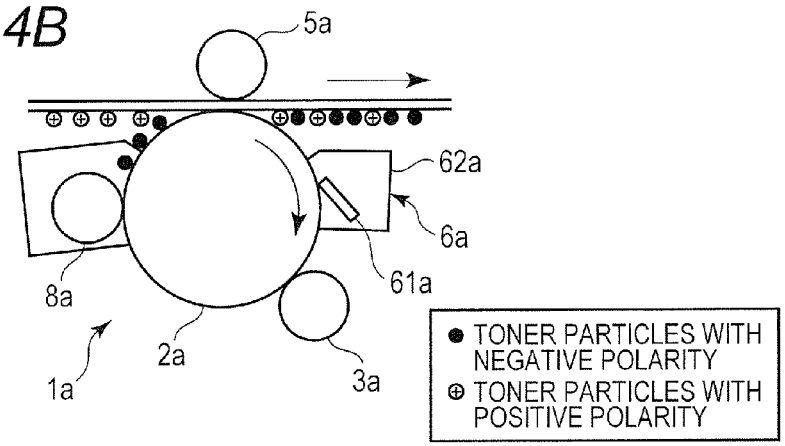
Figure 4C:
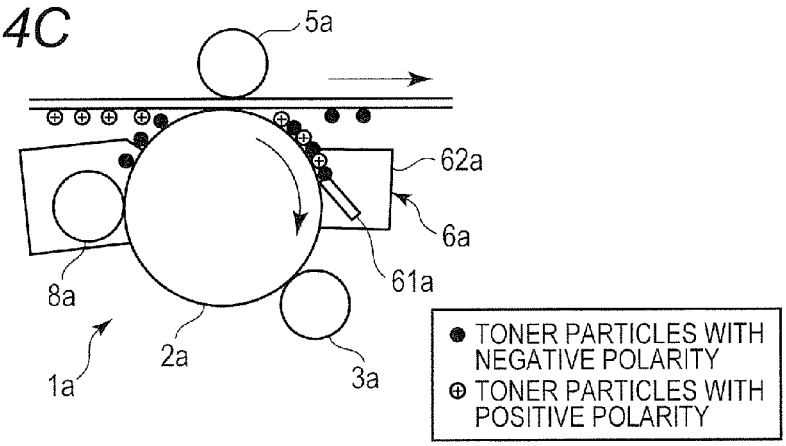

Depending on the charges of the secondary transfer residual toner, however, the "insufficient cleaning" or the "ghost" sometimes occurs. FIG. 4B is a schematic view for illustrating a state in which the "insufficient cleaning" occurs. When the charges of the secondary transfer residual toner are low at the time of movement of the secondary transfer residual toner charged to the positive polarity to the primary transfer portion N1*a* of the first image forming portion 1*a*, a force that is large enough to transfer the secondary transfer residual toner to the photosensitive member 2*a* is not generated, resulting in the secondary transfer residual toner remaining on the intermediate transferring belt 20. The secondary transfer residual toner remaining on the intermediate transferring belt 20 is transferred together with the yellow toner transferred from the photosensitive member 2*a* of the first image forming portion 1*a* onto the intermediate transferring belt 20, appearing as an image defect. Meanwhile, FIG. 4C is a schematic view for illustrating a state in which the "ghost" occurs. When the charges of the secondary transfer residual toner are high at the time of movement of the secondary transfer residual toner charged to the positive polarity to the primary transfer portion N1*a* of the first image forming portion 1*a*, the secondary transfer residual toner electrostatically adsorbs the yellow toner on the photosensitive member 2*a*, and is transferred onto the photosensitive member 2*a* together with the yellow toner. The yellow toner to be transferred onto the intermediate transferring belt 20 is disadvantageously collected by the photosensitive member 2*a* together with the secondary transfer residual toner. Therefore, an image lacking the yellow toner is transferred onto the recording material P, appearing as an image defect. Therefore, in order to normally clean the secondary transfer residual toner, the charges of the secondary transfer residual toner are required to be regulated.

In Table 2, a result of evaluation of cleaning performance in the configuration of this embodiment is shown. An experiment was carried out in the following procedure. Specifically, GFC-081 (Canon Marketing Japan Inc.; trade name) left under an environment at a temperature of 15° C. and a humidity of 10% for 48 hours to be dried was used as the recording material P. Further, three images, that is, a solid image (maximum-density level image), a half-tone image, and a character/fine-line image, were output for each of cyan, magenta, yellow, black, red, blue, and green while changing the voltage applied to the conductive brush 31 and the voltage applied to the charging roller 32. Then, for sampled evaluation images, the occurrence of the image defect due to the "insufficient cleaning" and the "ghost" was evaluated. More specifically, when the image, which is formed one revolution of the intermediate transferring belt 20 before, appeared on the sampled evaluation image in the same color as the color of the secondary transfer residual toner, the "insufficient cleaning" was determined. Further, when the image, which is formed one revolution of the intermediate transferring belt 20 before, lacked the yellow toner, it was determined that the "ghost" occurred as the image defect. Then, for each of the "insufficient cleaning" and the "ghost", the absence of the image defect was evaluated with a "Defect" mark, and the presence of the image defect was evaluated with a "Non-Defect" mark.

TABLE 2

| Charging roller | | Conductive brush | | Insufficient | |
|---|---|---|---|---|---|
| Bias | Current | Bias | Current | cleaning | Ghost |
| 800 V | 0 μA | 600 V | 0 μA | Defect | Non-Defect |
| 1,600 V | 10 μA | 700 V | 5 μA | Defect | Non-Defect |
| 2,200 V | 15 μA | 800 V | 8 μA | Defect | Non-Defect |
| 2,500 V | 20 μA | 1,000 V | 10 μA | Non-Defect | Non-Defect |
| 3,000 V | 25 μA | 1,100 V | 12 μA | Non-Defect | Non-Defect |
| 3,500 V | 30 μA | 1,200 V | 15 μA | Non-Defect | Defect |

As shown in Table 2, the cleaning performance is correlated with a value of current flowing through the conductive brush 31 and the charging roller 32 and a value of voltage applied to the conductive brush 31 and the charging roller 32. Specifically, when the voltage value of the conductive brush 31 was 800 V or lower and the voltage value of the charging roller 32 was 2,200 V or lower, "insufficient cleaning" occurred. Meanwhile, when the voltage value of the conductive brush 31 was 1,200 V or higher and the voltage value of the charging roller 32 was 3,500 V or higher, the secondary transfer residual toner was strongly charged to the positive polarity to cause the "ghost".

4. Case where Secondary Transfer Voltage is Set Stronger than Appropriate Value

Next, a case where any of the "explosion" and the "strong hollow" occurs in the configuration of this embodiment is described. In Table 3, there is shown a result of evaluation of occurrence of the "explosion" and the "strong hollow" in the configuration of this embodiment while changing the secondary transfer voltage when the recording material P different from that used in the experiment from which the result shown in Table 1 was obtained was used. The experiment was carried out in the following procedure. Specifically, Neenah Classic Crest Cover (Neenah Paper Inc.; trade name) left under an environment at a temperature of 15° C. and a humidity of 10% for 48 hours to be dried was used as the recording material P. Further, cyan, magenta, yellow, black, red, blue, and green solid images (maximum-density level images) were output while changing the secondary transfer voltage. Then, for the sampled evaluation images, the occurrence of the "explosion" and the occurrence of the "strong hollow" were evaluated. An evaluation method was the same as that used in the experiment from which the result of Table 1 was obtained. A basis weight of the above-mentioned Neenah Classic Crest Cover is 216 g/m$^2$, which is larger than 81.4 g/m$^2$ of GFC-081 used in the experiment from which the result of Table 1 was obtained. Hence, an electric resistance of Neenah Classic Crest Cover is larger than that of GFC-081 used in the experiment from which the result of Table 1 was obtained. Further, in the experiment using Neenah Classic Crest Cover, in view of fixability of the toner image onto the recording material P, a process speed was lowered to one-third of a process speed used in the experiment from which the result of Table 1 was obtained.

TABLE 3

| Secondary transfer bias voltage | Explosion | Transfer efficiency |
|---|---|---|
| 3,000 V | occurred | 70% |
| 3,200 V | occurred | 80% |
| 3,400 V | occurred | 85% |
| 3,600 V | occurred | 90% |
| 3,800 V | occurred | 85% |
| 4,000 V | Not occurred | 80% |

In general, when the electric resistance of the recording material P increases, a frequency of occurrence of "explosion" increases. As shown in Table 3, when the secondary transfer voltage was 3,800 V or lower, the "explosion" occurred. Further, when the secondary transfer voltage was 3,400 V or lower, the "weak hollow" occurred to lower the transfer efficiency. Further, when the secondary transfer voltage was 3,800 V or higher, the "strong hollow" occurred to lower the transfer efficiency. That is, when Neenah Classic Crest Cover is used, there is no range of the secondary transfer voltage where neither the "explosion" nor the "strong hollow" occurs. In this case, in order to suppress the "explosion" that is liable to be recognized as the image defect, it is desirable to perform the image formation at 4,000 V or higher as the set value of the secondary transfer voltage. When the secondary transfer voltage is set to the value at which the "strong hollow" may occur as described above, however, the "ghost" disadvantageously occurs in some cases.

In Table 4, a result of evaluation of cleaning performance when the secondary transfer voltage was set to 4,000 V or higher in the configuration of this embodiment is shown. Although an experiment procedure was the same as that of the experiment from which the result of Table 2 was obtained, Neenah Classic Crest Cover was used as the recording material P in this experiment. Further, an evaluation method was the same as that of the experiment from which the result of Table 2 was obtained.

TABLE 4

| Charging roller | | Conductive brush | | Insufficient | |
|---|---|---|---|---|---|
| Bias | Current | Bias | Current | cleaning | Ghost |
| 800 V | 0 μA | 600 V | 0 μA | Defect | Non-Defect |
| 1,600 V | 10 μA | 700 V | 5 μA | Defect | Non-Defect |
| 2,200 V | 15 μA | 800 V | 8 μA | Defect | Non-Defect |
| 2,500 V | 20 μA | 1,000 V | 10 μA | Non-Defect | Defect |
| 3,000 V | 25 μA | 1,100 V | 12 μA | Non-Defect | Defect |
| 3,500 V | 30 μA | 1,200 V | 15 μA | Non-Defect | Defect |

When the secondary transfer voltage is set to the value at which the "strong hollow" may occur, a ratio of the secondary transfer residual toner, which is charged to the positive polarity, increases. When the voltage value of the conductive brush 31 is 1,000 V or higher and the voltage value of the charging roller 32 is 2,500 V or higher, the toner, which is particularly strongly charged to the positive polarity in the secondary transfer residual toner, causes the "ghost". Specifically, the secondary transfer residual toner as described above is collected by the photosensitive member 2*a* together with the yellow toner at the primary transfer portion N1*a* of the first image forming portion 1*a*. As a result, a part of the yellow toner is not transferred onto the intermediate transferring belt 20. Meanwhile, the secondary transfer residual toner still contains the toner particles with the negative polarity or the toner particles having few charges. Therefore, without setting the voltage value of the conductive brush 31 to 1,000 V or higher and the voltage value of the charging roller 32 to 2,500 V or higher, the toner particles are not collected by the photosensitive member 2*a* at the first image forming portion 1*a* due to insufficient charging, thereby causing the insufficient cleaning. As described above, when the secondary transfer voltage is set to the value that may cause the "strong hollow" so as to suppress the "explosion", the secondary transfer residual toner is strongly charged to the positive polarity to prevent good cleaning in some cases.

5. Switching of Voltage of Conductive Brush

In this embodiment, when the secondary transfer voltage is set to the value at which the "strong hollow" may occur, the voltage with the negative polarity is applied to the conductive brush 31 while the secondary transfer residual toner is passing over the conductive brush 31.

Figure 5A:
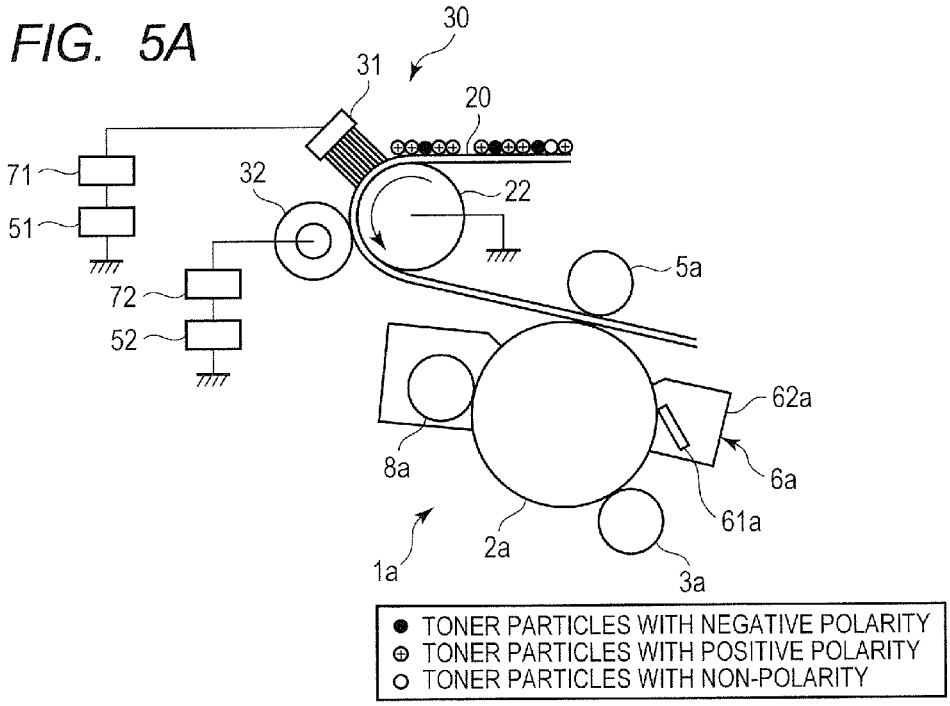
FIG. 5A and FIG. 5B are schematic diagrams for illustrating control according to the embodiment.

FIG. 5A is a schematic view of a vicinity of the belt cleaning mechanism 30 before the secondary transfer residual toner passes over the conductive brush 31. The secondary transfer residual toner contains the toner particles with the positive polarity, the toner particles with the negative polarity, and the toner particles with a non-polarity without charges. When the secondary transfer voltage is set to the value at which the "strong hollow" may occur, the charges of the toner particles of the positive polarity increase. The toner particles described above cause the "ghost".

Figure 5B:
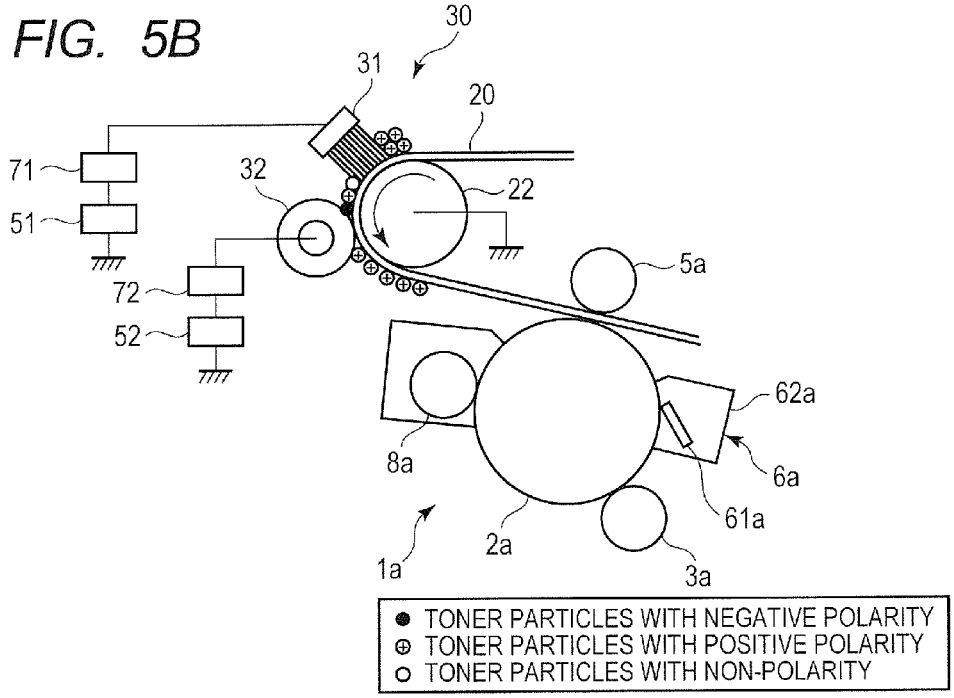

FIG. 5B is a schematic view of the vicinity of the belt cleaning mechanism 30 while the secondary transfer residual toner is passing over the conductive brush 31 applied with the voltage with the negative polarity. The voltage with the negative polarity is applied to the conductive brush 31. Therefore, the toner particles strongly charged to the positive polarity are captured by the conductive brush 31. As a result, the toner particles that pass over the conductive brush 31 are any one of toner particles weakly charged to the positive polarity, toner particles with few charges, and toner particles charged to the negative polarity. Those toner particles are uniformly charged to the positive polarity by the charging roller 32 to be collected by the photosensitive member 2*a* at the primary transfer portion N1*a* of the first image forming portion 1*a*. The voltage with the negative polarity applied to the conductive brush 31 only needs to have such a value as to electrostatically attract and hold the toner particles strongly charged to the positive polarity, and may typically be such a voltage as not to cause a discharge with the intermediate transferring belt 20.

In Table 5, a result of evaluation of the cleaning performance when the secondary transfer voltage was set to 4,000 V or higher and the voltage with the negative polarity was applied to the conductive brush 31 in the configuration of this embodiment is shown. Although an experiment procedure was the same as that of the experiment from which the result shown in Table 4 was obtained, the voltage applied to the conductive brush 31 was set to −200 V. Further, an evaluation method was the same as that of the experiment from which the result shown in Table 4 was obtained.

TABLE 5

| Charging roller | | Conductive brush | | Insufficient | |
|---|---|---|---|---|---|
| Bias | Current | Bias | Current | cleaning | Ghost |
| 800 V | 0 μA | −200 V | 0 μA | Defect | Non-Defect |
| 1,600 V | 10 μA | −200 V | 0 μA | Defect | Non-Defect |
| 2,200 V | 15 μA | −200 V | 0 μA | Defect | Non-Defect |
| 2,500 V | 20 μA | −200 V | 0 μA | Non-Defect | Non-Defect |
| 3,000 V | 25 μA | −200 V | 0 μA | Non-Defect | Non-Defect |
| 3,500 V | 30 μA | −200 V | 0 μA | Non-Defect | Defect |

In this case, when the voltage value of the charging roller 32 is set to 2,500 V or higher, the "insufficient cleaning" does not occur. When the voltage value of the charging roller 32 is set to 3,000 V or lower, the "ghost" does not occur. Therefore, by setting the voltage of the charging roller 32 to 2,500 V or higher and 3,000 V or lower, good image formation and cleaning can be performed.

Specifically, in this embodiment, the image forming apparatus 10 can execute the image formation in a normal sheet mode and a thick sheet mode as a plurality of image formation modes. The thick sheet mode is the image formation mode that is selected when the printing is performed using the recording material (thick sheet) P having a larger basis weight than a basis weight of the recording material (normal sheet) P used for printing in the normal sheet mode. The image formation mode is selected by, for example, inputting an instruction to the control unit 11 through the operation unit 12 included in the image forming apparatus 10 or an operation unit (not shown) of an external apparatus, for example, a personal computer, which is connected to the image forming apparatus 10 so as to be communicable to/from each other. When the thick sheet mode is selected, the control unit 11 sets the secondary transfer voltage stronger (4,000 V or higher in this embodiment) than the appropriate value and the voltage of the conductive brush 31 to the negative polarity (−200 V in this embodiment) so as to execute the image formation.

The toner particles captured by the conductive brush 31 as described above are transferred from the conductive brush 31 to the intermediate transferring belt 20, to be transferred onto the photosensitive member 2 so as to be collected by applying a voltage to the conductive brush 31 with the positive polarity during the non-image formation period, for example, the post-rotation step for the job. In this embodiment, after the image formation (primary transfer) at the first image forming portion 1*a* is finished for the job, the voltage with the positive polarity is applied to the conductive brush 31 at timing at which the toner particles discharged from the conductive brush 31 reach the primary transfer portion N1*a* of the first image forming portion 1*a*. In this manner, the toner particles charged to the positive polarity, which are discharged from the conductive brush 31, are transferred onto the photosensitive member 2*a* of the first image forming portion 1*a* so as to be collected. At this time, a potential of the photosensitive member 2*a* and the voltage applied to the primary transfer roller 5*a* are maintained under the same conditions as those during the image formation. Further, the voltage with the positive polarity is applied to the charging roller 32 so as to allow the toner particles with the positive polarity discharged from the conductive brush 31 to pass thereover, as during the cleaning operation. The toner particles discharged from the conductive brush 31 to be transferred onto the intermediate transferring belt 20 are strongly charged to the positive polarity. However, the image formation has already been completed. Thus, there is no toner particle collected together with the discharged toner particles, and hence the "ghost" does not occur.

As described above, in this embodiment, the control unit 11 causes the cleaning operation in a first mode and the cleaning operation in a second mode to be selectively executed in accordance with the secondary transfer voltage. Specifically, the cleaning operation is switched between the first mode in which application of a primary transfer voltage to the secondary transfer roller 24 is set and the second mode in which application of a secondary transfer voltage larger than the primary transfer voltage to the secondary transfer roller 24 is set.

In the cleaning operation in the first mode, the voltage with the polarity opposite to the original charging polarity of the toner is applied to the first charging member 31 and the second charging member 32. In the second mode, the voltages having different polarities are respectively applied to the first charging member 31 and the second charging member 32. The cleaning operation in the first mode is executed when the secondary transfer voltage is set to an appropriate value with which the transfer efficiency of a predetermined value or larger is obtained. On the other hand, the cleaning operation in the second mode is executed when the secondary transfer voltage is set to a value which has an absolute value larger than the appropriate value and with which the transfer efficiency becomes lower than the transfer efficiency obtained with the appropriate value.

As described above, in this embodiment, the voltage with the positive polarity is applied to the conductive brush 31. In this manner, the secondary transfer residual toner particles strongly charged to the positive polarity are captured by the conductive brush 31 so as to prevent the toner particles strongly charged to the positive polarity from being collected at the image forming portion 1 during the image formation. In this manner, even when the secondary transfer voltage is set to the voltage higher than the appropriate value, at which the "strong hollow" may occur, good cleaning can be performed.

In this embodiment, the toner particles strongly charged to the positive polarity are captured by the conductive brush 31 arranged on the upstream side and the toner particles with the negative polarity and the toner particles with few charges are charged to the positive polarity by the charging roller 32 arranged on the downstream side. Although a good result is obtained in the above-mentioned mode, a part of the secondary transfer residual toner only needs to be captured by one charging member, while another part of the secondary transfer residual toner only needs to be charged to the polarity opposite to the original charging polarity by another charging member. Therefore, conversely to the configuration of this embodiment, the toner particles strongly charged to the positive polarity may be captured by the charging member arranged on the downstream side, while the toner particles with the negative polarity and the toner particles with few charges may be charged to the positive polarity by the charging member arranged on the upstream side. In this case, the charging member arranged on the upstream side may be a roller, while the charging member arranged on the downstream side may be a brush.

Second Embodiment

Next, another embodiment of the present invention is described. The basic configuration and operation of an image forming apparatus of a second embodiment of the present invention are the same as those of the first embodiment. The description in the first embodiment is used for components having a function or configuration that is the same as or corresponding to those of the first embodiment, and an overlapping detailed description thereof is herein omitted.

As described in the first embodiment, when the printing is continuously performed on a large number of sheets under a state in which the voltage with the negative polarity is applied to the conductive brush 31, the amount of toner held on the conductive brush 31 continues to increase. When the amount of held toner exceeds a certain amount, the conductive brush 31 cannot hold the toner anymore. As a result, a part of the toner strongly charged to the positive polarity passes over the conductive brush 31 to cause the "ghost".

In Table 6, a result of evaluation of the cleaning performance after printing was continuously performed on 100 sheets in the configuration of the second embodiment is shown. An experiment procedure was the same as that of the experiment from which the result shown in Table 5 was obtained. In this case, after a predetermined image was continuously printed on 100 sheets, a solid image (maximum-density level image) was output for each of cyan, magenta, yellow, black, red, blue, and green. An evaluation method is the same as that of the experiment from which the result of Table 5 was obtained.

TABLE 6

| Charging roller | | Conductive brush | | Insufficient | |
|---|---|---|---|---|---|
| Bias | Current | Bias | Current | cleaning | Ghost |
| 800 V | 0 μA | −200 V | 0 μA | Defect | Non-Defect |
| 1,600 V | 10 μA | −200 V | 0 μA | Defect | Non-Defect |

TABLE 6-continued

| Charging roller | | Conductive brush | | Insufficient | |
|---|---|---|---|---|---|
| Bias | Current | Bias | Current | cleaning | Ghost |
| 2,200 V | 15 μA | −200 V | 0 μA | Defect | Non-Defect |
| 2,500 V | 20 μA | −200 V | 0 μA | Defect | Defect |
| 3,000 V | 25 μA | −200 V | 0 μA | Non-Defect | Defect |
| 3,500 V | 30 μA | −200 V | 0 μA | Non-Defect | Defect |

In this case, when the voltage value of the charging roller 32 is set to 2,500 V or lower, the "insufficient cleaning" occurs. When the voltage value of the charging roller 32 is set to 2,500 V or higher, the "ghost" occurs. In contrast to the result shown in Table 5, even when the voltage value of the charging roller 32 is changed, not both of the "insufficient cleaning" and the "ghost" can be suppressed. This is because the toner stays on the conductive brush 31 and cannot be held anymore so that the toner strongly charged to the positive polarity passes over the conductive brush 31.

Therefore, in the second embodiment, when the secondary transfer voltage is set to a value at which the "strong hollow" may occur and the continuous printing is performed on a large number of sheets while applying the voltage with the negative polarity to the conductive brush 31, the following control is performed. Specifically, the image formation is temporarily interrupted to increase a sheet interval at a time at which the continuous printing on a predetermined number of sheets is completed so that the conductive brush 31 can continue holding the toner even in the above-mentioned case. Then, the voltage with the positive polarity is applied to the conductive brush 31 in the sheet interval so that the toner charged to the positive polarity is discharged from the conductive brush 31 onto the intermediate transferring belt 20. During the interruption of the image formation, the toner is collected by the photosensitive member 2*a* of the first image forming portion 1*a*. In this manner, the toner held by the conductive brush 31 is removed so that the conductive brush 31 can hold the toner again. In this embodiment, the above-mentioned discharge operation is executed for every 50 sheets of the continuous printing as the predetermined number of sheets. However, a frequency of execution of the discharge operation is not limited to that of this embodiment, and can be appropriately set in accordance with toner retention capability of the conductive brush 31.

Specifically, in this embodiment, when the thick sheet mode is selected, the control unit 11 sets the secondary transfer voltage higher than the appropriate value (4,000 V or higher in this embodiment) and the voltage of the conductive brush 31 to the negative polarity (−200 V in this embodiment) so as to execute the image formation. Then, the sheet interval is increased for every 50 sheets of the continuous printing so that an operation of discharging the toner from the conductive brush 31 and collecting the toner by the photosensitive member 2*a* of the first image forming portion 1*a* is executed.

In Table 7, a result of evaluation of the cleaning performance when the image formation was interrupted for every 50 sheets of the continuous printing so as to remove the toner on the conductive brush 31 in the configuration of this embodiment is shown. An experiment procedure and an evaluation method were the same as those of the experiment from which the result shown in Table 6 was obtained.

TABLE 7

| Charging roller | | Conductive brush | | Insufficient | |
|---|---|---|---|---|---|
| Bias | Current | Bias | Current | cleaning | Ghost |
| 800 V | 0 μA | −200 V | 0 μA | Defect | Non-Defect |
| 1,600 V | 10 μA | −200 V | 0 μA | Defect | Non-Defect |
| 2,200 V | 15 μA | −200 V | 0 μA | Defect | Non-Defect |
| 2,500 V | 20 μA | −200 V | 0 μA | Non-Defect | Non-Defect |
| 3,000 V | 25 μA | −200 V | 0 μA | Non-Defect | Non-Defect |
| 3,500 V | 30 μA | −200 V | 0 μA | Non-Defect | Defect |

In this case, when the voltage value of the charging roller 32 is set to 2,500 V or higher, the "insufficient cleaning" does not occur. When the voltage value of the charging roller 32 is set to 3,000 V or lower, the "ghost" does not occur. Therefore, by setting the voltage of the charging roller 32 to 2,500 V or higher and 3,000 V or lower, good image formation and cleaning can be performed.

As described above, when the printing is continuously performed on a large number of sheets, the image formation is temporarily interrupted so as to perform the operation of discharging the toner from the conductive brush 31. In this manner, good cleaning can be performed.

Although the operation of discharging the toner from the conductive brush 31 is executed each time the image formation on a predetermined number of sheets is completed in this embodiment, the execution of the operation is not limited thereto. For example, the amount of toner held on the conductive brush 31 may be directly detected so that the operation of discharging the toner from the conductive brush is executed when the amount of held toner exceeds a predetermined amount. For example, the amount of the secondary transfer residual toner is correlated with the amount of toner of the image formed on the intermediate transferring belt 20. Therefore, the amount of toner held on the conductive brush 31 can be estimated based on information of the image to be formed. Alternatively, the electric resistance of the conductive brush 31 is correlated with the amount of toner held on the conductive brush 31. Therefore, the amount of toner held on the conductive brush 31 can be estimated by detecting a value of current flowing when a predetermined voltage is applied to the conductive brush 31 or a value of output voltage obtained when a predetermined current is caused to flow through the conductive brush 31.

Third Embodiment

Next, yet another embodiment of the present invention is described. The basic configuration and operation of an image forming apparatus of a third embodiment of the present invention are the same as those of the first embodiment. The description in the first embodiment is used for components having a function or configuration that is the same as or corresponding to those of the first embodiment, and an overlapping detailed description thereof is herein omitted.

As described above, the "ghost" occurs due to the presence of the secondary transfer residual toner strongly charged to the positive polarity. Therefore, when the secondary transfer residual toner strongly charged to the positive polarity is not present, it is desirable to apply the positive voltage as in a normal case so as to collect the secondary transfer residual toner as much as possible simultaneously with the primary transfer without applying the negative voltage to the conductive brush 31 to capture the toner with the conductive brush 31. The reason for this is as follows. For example, in the case of the continuous printing as in the second embodiment, when the image formation is temporarily interrupted so as to perform the operation of discharging the toner from the conductive brush 31, downtime (period in which an image cannot be output) is generated to lower productivity in the image formation in some cases.

Figure 6:
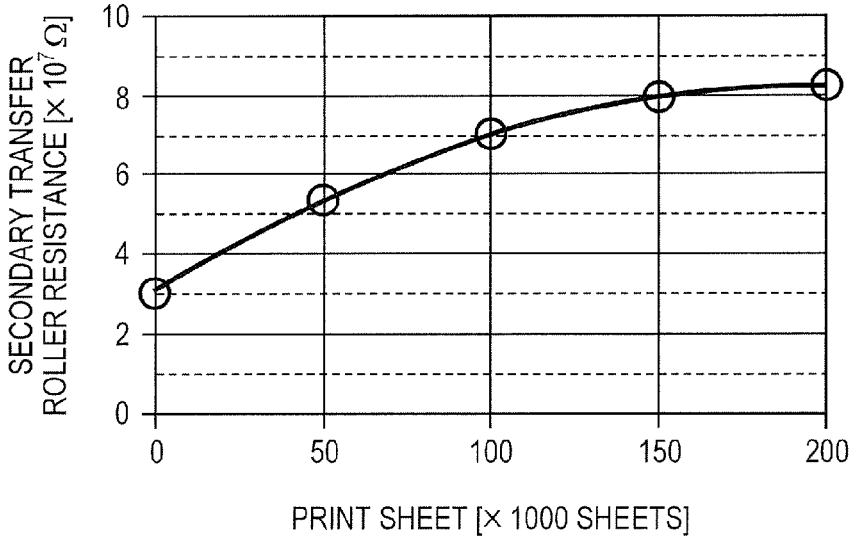
FIG. 6 is a graph for showing a relationship between the number of printed sheets and an electric resistance value of a secondary transfer roller.

The electric resistance value of the secondary transfer roller 24 is sometimes increased along with an increase in the number of printed sheets. This is mainly because a surface of the roller is oxidized by a discharge caused on the secondary transfer roller 24 at the time of printing. FIG. 6 is a graph for showing an example of a change in electric resistance value of the secondary transfer roller 24 from an electric resistance value in an unused state in accordance with the number of printed sheets.

Further, in general, when the electric resistance value of the secondary transfer roller 24 increases, the occurrence of the "explosion" tends to be reduced. Therefore, when the electric resistance value of the secondary transfer roller 24 increases, it may be possible to set the secondary transfer voltage to a value at which the "strong hollow" does not occur.

In Table 8, there is shown a result of evaluation of occurrence of the "explosion" and the "strong hollow" when the secondary roller 24, which has the electric resistance value increased to $5.5\times10^{7}\Omega$ after the printing of 50,000 sheets, was used. An experiment procedure and an evaluation method were the same as those of the experiment from which the result shown in Table 3 was obtained.

TABLE 8

| Secondary transfer bias voltage | Explosion | Transfer efficiency |
|---|---|---|
| 4,000 V | occurred | 70% |
| 4,200 V | occurred | 80% |
| 4,400 V | occurred | 85% |
| 4,600 V | occurred | 90% |
| 4,800 V | Not occurred | 90% |
| 5,000 V | Not occurred | 80% |

As shown in Table 8, when the secondary transfer voltage was equal to or lower than 4,600 V, the "explosion" occurred. That is, even at the secondary transfer voltage lower than that in the case of Table 3, the "explosion" did not occur. Further, when the secondary transfer voltage was 4,400 V or lower, the "weak hollow" occurred to lower the transfer efficiency. Further, when the secondary transfer voltage was 5,000 V or higher, the "strong hollow" occurred to lower the transfer efficiency. Specifically, in this case, by setting the set value of the secondary transfer voltage to 4,800 V, both the "explosion" and the "strong hollow" can be suppressed so as to perform good image formation. The electric resistance value of the secondary transfer roller 24 is increased. Therefore, the set value of the secondary transfer voltage is higher than that in the case of Table 3.

In particular, in the third embodiment, the control unit 11 functions as a counting unit configured to count the amount of use of the secondary transfer roller 24 as information correlated with the electric resistance value of the secondary transfer roller 24 so as to start counting the number of printed sheets when the secondary transfer roller 24 is in an unused state to successively update and store the number of printed sheets in the storage unit. The control unit 11 determines the secondary transfer voltage in accordance with the amount of use of the secondary transfer roller 24 by checking the number of printed sheets by the secondary transfer roller 24. Then, when the secondary transfer voltage is set to the value at which the "strong hollow" may occur (specifically, the transfer efficiency is lowered because of the value being larger than the appropriately value), the control unit 11 sets the voltage of the conductive brush 31 to the negative polarity. Otherwise, the control unit 11 sets the voltage of the conductive brush 31 to the positive polarity so as to execute the image formation.

As described above, in this embodiment, when the electric resistance value of the secondary transfer roller 24 is smaller than the predetermined value, the control unit 11 causes the cleaning operation in the first mode and the cleaning operation in the second mode to be selectively executed. On the other hand, when the electric resistance value of the secondary transfer roller 24 is equal to or larger than the predetermined value, the control unit 11 causes the cleaning operation in the first mode to be executed. In other words, in this embodiment, in a predetermined image formation mode, for example, the thick sheet mode, the cleaning operation in the first mode and the cleaning operation in the second mode are selectively executed in accordance with the electric resistance value of the secondary transfer roller 24. Specifically, when the electric resistance value of the secondary transfer member is equal to or larger than the predetermined value, the cleaning operation in the first mode is executed. When the electric resistance value is smaller than the predetermined value, the cleaning operation in the second mode is executed.

As described above, in the third embodiment, the voltage with the negative polarity is selectively applied to the conductive brush 31 when there is a possibility of occurrence of the "ghost" based on the information correlated with the electric resistance value of the secondary transfer roller. As a result, good image formation can be performed while enhancing productivity.

Although the information on the number of printed sheets, which is use-amount information of the secondary transfer roller 24, is used as the information correlated with the electric resistance value of the secondary transfer roller 24, the information is not limited thereto. For example, as the use-amount information of the secondary transfer roller 24, any information correlated with the amount of use of the secondary transfer roller 24 such as the number of revolutions of the secondary transfer roller 24, use time of the secondary transfer roller 24, and application time of the secondary transfer voltage may be used. Further, the electric resistance of the secondary transfer roller 24 may be more directly detected. For example, by detecting a current value obtained when a predetermined voltage is applied to the secondary transfer roller 24 or a value of output voltage obtained when a predetermined current is caused to flow through the secondary transfer roller 24 under a state in which the recording material P is not present at the secondary transfer portion N2 as in the pre-rotation step, information relating to the electric resistance value of the secondary transfer roller 24 can be acquired. Then, the control unit 11 can determine the secondary transfer voltage in the same manner as described above based on the acquired information relating to the electric resistance value.

[Others]

The present invention is specifically described above by way of embodiments. However, the present invention is not limited to the embodiments described above.

In the embodiments described above, the secondary transfer residual toner has been described as being collected at the image forming portion on the uppermost stream side in the direction of travel of the intermediate transfer member. However, the present invention is not limited thereto. The secondary transfer residual toner can be collected simultaneously with the primary transfer at one or a plurality of arbitrary image forming portions. For example, when the amount of secondary transfer residual toner is relatively large, the secondary transfer residual toner that has not been completely collected at the image forming portion on the uppermost stream side may be collected at the image forming portion arranged on a downstream side of the image forming portion arranged on the uppermost stream side. Alternatively, the secondary transfer residual toner can be prevented from being collected by stopping the primary transfer voltage or setting the same polarity as the original charging polarity of the toner at the image forming portion at which the image formation (primary transfer) for the job has already been completed at the time at which the secondary transfer residual toner reaches the primary transfer portion. In this case, the secondary transfer residual toner can be collected at the image forming portion on the downstream side of the above-mentioned image forming portion, in which, for example, the image formation (primary transfer) has not been completed.

Further, although the toner discharged from the charging member in the post-rotation step or the image interval step has been described as being collected at the image forming portion on the uppermost stream side in the direction of travel of the intermediate transfer member, the present invention is not limited thereto. The discharged toner can be collected at one or a plurality of arbitrary image forming portions. At this time, in the image forming portion through which the discharged toner is desired to be caused to pass, the primary transfer voltage only needs to have the polarity opposite to the original charging polarity of the toner or the intermediate transfer member only needs to be separated away from the photosensitive member.

Still further, although the voltage with the same polarity as the original charging polarity of the toner is applied to the charging member when the toner is discharged from the charging member, the voltage with the positive polarity and the voltage with the negative polarity may be repeatedly switched to be applied so as to enhance discharge efficiency. Further, the toner can be satisfactorily discharged simply by turning off the voltage (or bringing the voltage into a grounded state) depending on an apparatus configuration.

Still further, although the secondary transfer voltage is set higher than the appropriate value and the voltage with the same polarity as the original charging polarity of the toner is applied to the charging member when the basis weight of the recording material on which the image is formed is larger than the predetermined value in the embodiments described above, the application of the secondary transfer voltage is not limited thereto. When operation setting has a possibility of occurrence of the "ghost" by setting the secondary transfer voltage higher than the appropriate value, the occurrence of "ghost" can be suppressed by applying the voltage with the same polarity as the original charging polarity of the toner to the charging member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-073095, filed Mar. 31, 2016, which is hereby incorporated by reference herein in its entirety.

What is claimed is:

1. An image forming apparatus, comprising:

an image bearing member configured to bear a toner image thereon;

an intermediate transferring member onto which the toner image is to be primarily transferred from the image bearing member;

a secondary transfer member configured to secondarily transfer the toner image from the intermediate transferring member onto a recording material;

a transfer power supply unit configured to apply a transfer voltage to the secondary transfer member;

a first charging member configured to charge residual toner remaining on the intermediate transferring member;

a second charging member configured to charge the residual toner remaining on the intermediate transferring member;

a charging power supply unit configured to apply a charging voltage to each of the first charging member and the second charging member; and a control unit configured to control the charging power supply unit, wherein the control unit is configured to cause a voltage with a polarity opposite to an original charging polarity of toner to be applied from the charging power supply unit to the first charging member and the second charging member in a first mode in which application of a first transfer voltage from the transfer power supply unit to the secondary transfer member is set, and cause a voltage with the original charging polarity to be applied from the charging power supply unit to the first charging member and the voltage with the opposite polarity to be applied from the charging power supply unit to the second charging member in a second mode in which application of a second transfer voltage higher than the first transfer voltage from the transfer power supply unit to the secondary transfer member is set.

2. An image forming apparatus according to claim 1, wherein the first charging member is arranged on a downstream side of the secondary transfer member and on an upstream side of the second charging member in a direction of rotation of the intermediate transferring member.

3. An image forming apparatus according to claim 1, wherein the control unit is configured to apply the voltage with the opposite polarity to the first charging member during a non-image formation period after execution of the second mode.

4. An image forming apparatus according to claim 3, wherein the non-image formation period comprises a period corresponding to a post-rotation step after completion of formation of all images for a job for forming and outputting an image on at least one recording material.

5. An image forming apparatus according to claim 3, wherein the non-image formation period comprises a period corresponding to an image interval step in a job for forming and outputting images on a plurality of recording materials.

6. An image forming apparatus according to claim 1, wherein secondary transfer efficiency when the first transfer voltage is set is higher than secondary transfer efficiency when the second transfer voltage is set.

7. An image forming apparatus according to claim 1, wherein the control unit is configured to cause the first mode and the second mode to be selectively executed when an electric resistance value of the secondary transfer member is smaller than a predetermined value, and to cause the first mode to be executed when the electric resistance value of the secondary transfer member is equal to or larger than the predetermined value.

8. An image forming apparatus, comprising:

an image bearing member configured to bear a toner image thereon;

an intermediate transferring member onto which the toner image is to be primarily transferred from the image bearing member;

a secondary transfer member configured to secondarily transfer the toner image from the intermediate transferring member onto a recording material;

a transfer power supply unit configured to apply a transfer voltage to the secondary transfer member;

a first charging member configured to charge residual toner remaining on the intermediate transferring member;

a second charging member configured to charge the residual toner remaining on the intermediate transferring member;

a charging power supply unit configured to apply a charging voltage to each of the first charging member and the second charging member; and a control unit configured to control the charging power supply unit, wherein the control unit is configured to cause a voltage with a polarity opposite to an original charging polarity of toner to be applied from the charging power supply unit to the first charging member and the second charging member in a normal sheet mode, and cause a voltage with the original charging polarity to be applied from the charging power supply unit to the first charging member and the voltage with the opposite polarity to be applied from the charging power supply unit to the second charging member in a thick sheet mode.

9. An image forming apparatus according to claim 8, wherein the first charging member is arranged on a downstream side of the secondary transfer member and on an upstream side of the second charging member in a direction of rotation of the intermediate transferring member.

10. An image forming apparatus according to claim 8, wherein the control unit is configured to apply the voltage with the opposite polarity to the first charging member during a non-image formation period after execution of the thick sheet mode.

11. An image forming apparatus according to claim 10, wherein the non-image formation period comprises a period corresponding to a post-rotation step after completion of formation of all images for a job for forming and outputting an image on at least one recording material.

12. An image forming apparatus according to claim 10, wherein the non-image formation period comprises a period corresponding to an image interval step in a job for forming and outputting images on a plurality of recording materials.

* * * * *